US009475204B2

(12) United States Patent
Koch et al.

(10) Patent No.: US 9,475,204 B2
(45) Date of Patent: Oct. 25, 2016

(54) FOOD SLICER WITH SUPPORT ELEMENT

(75) Inventors: Klaus Koch, Geislingen (DE); Sebastian Ruff, Grosselfingen (DE)

(73) Assignee: BIZERBA GMBH & CO. KG, Balingen (DE)

( * ) Notice: Subject to any disclaimer, the term of this patent is extended or adjusted under 35 U.S.C. 154(b) by 1243 days.

(21) Appl. No.: 12/939,447

(22) Filed: Nov. 4, 2010

(65) Prior Publication Data

US 2011/0056356 A1 Mar. 10, 2011

Related U.S. Application Data

(63) Continuation of application No. PCT/EP2009/055614, filed on May 8, 2009.

(30) Foreign Application Priority Data

May 14, 2008 (DE) ..... 10 2008 024 437

(51) Int. Cl.

| | |
|---|---|
| ***B26D 1/143*** | (2006.01) |
| ***B26D 7/01*** | (2006.01) |
| ***B26D 7/06*** | (2006.01) |
| *B26D 7/00* | (2006.01) |
| *B26D 7/08* | (2006.01) |

(52) U.S. Cl.

CPC ..... *B26D 7/0616* (2013.01); *B26D 7/01* (2013.01); *B26D 1/143* (2013.01); *B26D 7/00* (2013.01); *B26D 7/08* (2013.01); *B26D 2210/02* (2013.01); *Y10S 83/932* (2013.01); *Y10T 83/536* (2015.04); *Y10T 83/6499* (2015.04); *Y10T 83/6536* (2015.04); *Y10T 83/7684* (2015.04); *Y10T 83/85* (2015.04)

(58) Field of Classification Search

CPC B26D 7/0616; B26D 2210/02; B26D 1/143; B26D 7/00; B26D 7/01; B26D 7/08; Y10S 83/932; Y10T 83/536; Y10T 8/6492; Y10T 83/6499; Y10T 83/6508; Y10T 83/6515; Y10T 83/6536; Y10T 83/7684

USPC ..... 83/703, 713, 707, 367, 471, 717, 730, 83/932

See application file for complete search history.

(56) References Cited

U.S. PATENT DOCUMENTS

| | | | |
|---|---|---|---|
| 1,138,509 | A | 5/1915 | Sayer |
| 1,778,102 | A | 10/1930 | Campbell |

(Continued)

FOREIGN PATENT DOCUMENTS

| | | |
|---|---|---|
| DE | 276 233 | 7/1914 |
| DE | 672 034 | 2/1939 |

(Continued)

*Primary Examiner* — Clark F Dexter

(74) *Attorney, Agent, or Firm* — Jeremy Jay

(57) ABSTRACT

The invention relates to a food product cutting machine comprising a driven cutting knife, a receiving device for product to be cut, a height adjustment device for the receiving device by means of which a height position of product to be cut relative to the cutting knife is adjustable, a carriage displaceable relative to the cutting knife and having the receiving device arranged thereat, and a support device for product to be cut having at least one support element and being capable of supporting product to be cut on a support face as it is cut, wherein the support device for product to be cut is coupled with the height adjustment device, the position of the effective support face being predetermined by the height position of the receiving device.

10 Claims, 9 Drawing Sheets

(56) References Cited

U.S. PATENT DOCUMENTS

| | | | |
|---|---|---|---|
| 2,010,943 | A | 8/1935 | Campbell |
| 2005/0072322 | A1 | 4/2005 | Weber |
| 2006/0185491 | A1 | 8/2006 | Graef |

FOREIGN PATENT DOCUMENTS

| | | |
|---|---|---|
| DE | 971 709 | 3/1959 |
| DE | 1 133 862 | 7/1962 |
| DE | 29 36 106 | 3/1980 |
| DE | 36 43 134 | 6/1988 |
| DE | 41 01 051 | 7/1992 |
| DE | 195 15 034 | 11/1995 |
| DE | 101 48 595 | 4/2003 |
| DE | 103 07 084 | 9/2004 |
| DE | 10 2004 037 996 | 3/2006 |
| EP | 1 020 260 | 7/2000 |
| EP | 1 681 141 | 7/2006 |
| JP | 200034388 | 12/2000 |

FOOD SLICER WITH SUPPORT ELEMENT

This application is a continuation of international application number PCT/EP2009/055614 filed on May 8, 2009.

The present disclosure relates to the subject matter disclosed in international application number PCT/EP2009/055614 of May 8, 2009 and German application No. 10 2008 024 437.6 of May 14, 2008, which are incorporated herein by reference in their entirety and for all purposes.

BACKGROUND OF THE INVENTION

The invention relates to a food product cutting machine comprising a driven cutting knife, a receiving device for product to be cut, a height adjustment device for the receiving device by means of which a height position of the product to be cut relative to the cutting knife can be adjusted, and a carriage displaceable relative to the cutting knife and having the receiving device arranged thereat.

DE 41 01 051 A1 discloses a universal slicing machine having a circular knife and a trough-like carriage which is displaceable parallel to the circular knife and designed to receive the product to be cut. A feed device for the product to be cut is provided which is configured such that the product to be cut is advanced at an acute angle to the knife plane of the circular knife and also at an acute angle to the rest plane of the trough-like carriage.

DE 36 43 134 A1 discloses a slicing machine for food products in which alongside a guide face for product to be cut, a cutting area of a knife is adjacent to a support rib having a support face for the product to be cut lying approximately in the plane of the guide face.

EP 1 681 141 A1 discloses a cutting machine for food products comprising reset means which, upon movement from a first position to a second position of a rest face for product to be cut, can exert a reset force on the rest face, the first position enclosing a non-zero angle with the horizontal and the second position being a horizontal position.

From DE 10 2004 037 996 A1 a cutting device for products is known which consists of a machine housing and a rotatably driven knife arranged in a knife holder, the axis of rotation of the knife being movable in the cutting plane. The knife holder and/or the knife is connected to the machine housing via first and second linear displacement means arranged substantially side-by-side.

DE 103 07 084 A1 discloses a cutting machine for food products having a machine housing, a rotary cutting knife, and a carriage being movable back and forth parallel to the knife plane and having a rest for product to be cut in the carriage area, wherein the rest for product to be cut comprises a rest wall and a contact wall for the product to be cut which are at an angle to each other, and wherein the rest wall for the product to be cut can adopt an acute angle with the standing plane of the machine housing. The rest for product to be cut is provided with a pivoting device by means of which the rest wall can optionally be put into a horizontal position, parallel with the standing plane, or an upward-pivoted position in which the rest wall adopts an acute angle with the standing plane of the machine housing.

DE 672 034 discloses a slicing machine having a rotary circular knife and a table for product to be cut which is suspended for pendulum movement about an axis. The rest face of the table for product to be cut is of circular arc-shaped configuration, all points on said face being radially equidistant from the fulcrum, which lies in the axis of suspension.

DE 1 133 862 discloses a cutting machine for bread, cold cuts or the like having a circular knife arranged at the side of the rest face for the product to be cut. Arranged on the discharge side of the circular knife is a holder which carries a scraper. The scraper is matched to the shape of the blade of the circular knife, or it is resiliently urged against the circular knife on the discharge side thereof and capable of being folded down, wherein when the holder is in the folded-up position, the upper edge of the scraper is located at the height of the rest face, and wherein when the holder is in the folded-down position, the knife blade and the scraper are accessible for cleaning.

DE 276 233 discloses a slicing machine having a vertical circular knife and a carriage which is moved in the horizontal direction and which carries the product to be cut, and a support which is itself supported by the machine frame. The support, which is brought close to the cutting location of the knife, is located between the carriage and the knife.

A further meat cutting machine is known from U.S. Pat. No. 1,138,509.

DE 29 36 106 A1 discloses a slicing machine for food products having an electrically driven circular knife, a carriage for product to be cut, and an adjustable stop plate for adjusting the cutting thickness. A sensor device is provided which senses the diameter or the width and height of the product to be cut and which is followed by an electronic circuit, preferably a microprocessor, for determining the blade number required for a preset or presettable weight at a particular cutting thickness. A counting device for counting the cutting movements is arranged in the path of motion of the carriage for product to be cut. Furthermore, a coincidence circuit is provided between the microprocessor and the counter device with a downstream signalling device.

Meat cutting machines are also known from JP 2000343488 A, U.S. Pat. No. 2,010,943 and U.S. Pat. No. 1,778,102.

SUMMARY OF THE INVENTION

In accordance with an embodiment of the invention, a food product cutting machine is provided which allows a good cutting result to be obtained in a simple manner.

In accordance with an embodiment of the invention, a support device for product to be cut is provided having at least one support element and being capable of supporting product to be cut on a support face as it is cut; the support device for product to be cut is coupled with the height adjustment device, the position of the effective support face being predetermined by the height position of the receiving device.

The height adjustment device allows an optimized cutting result to be achieved as a function of the diameter of the product to be cut. In order for transverse forces and, with them, tearing forces to be minimized, a velocity vector should be as perpendicular as possible to a direction of movement of the carriage when the cutting knife penetrates product to be cut. The point of penetration depends on the diameter of the product to be cut. The height adjustment device allows an adaptation to be achieved in order to thus minimize tearing forces.

The solution in accordance with the invention additionally provides a support device for product to be cut by means of which product to be cut can be supported as it is cut. The support device for product to be cut constitutes a counter-element (anvil element) during cutting in order to obtain an optimized cutting result.

In accordance with the invention, the support device for product to be cut is coupled with the height adjustment device. This allows the corresponding height of the effective support face to be adjusted, and in particular automatically adjusted, in a manner adapted to the respective height position of the receiving device. This enables, in a simple (and automated) manner, both a rest face of the receiving device and the support face to be at the same height to thereby achieve a "continuous" transition of the product to be cut and, as a result of this, an optimized cutting result.

In particular, a control device is provided for controlling the height position of the receiving device. This enables an automatic adjustment to be achieved in a simple manner; a manual adjustment of the corresponding height position of the receiving device is therefore unnecessary. The control device outputs corresponding signals to the height adjustment device, and the receiving device is displaced into the appropriate height position via a corresponding drive.

In an embodiment, a sensor device for determining a diameter of the product to be cut is provided, wherein the sensor device provides signals to the control device and the control device controls the height adjustment device for adjusting the height position adapted to the diameter of the product to be cut. This enables automatic adjustment of the proper height position for the respective product to be cut. The sensor device is, for example, an optical sensor device which optically detects the diameter of the product to be cut. Other sensor devices are possible, such as, for example, mechanical sensor devices or the like.

In an alternative embodiment, an operator control device is coupled to the control device, and the operator control device can then be used by an operator to set a parameter for the height position and/or a parameter for the diameter of the product to be cut. The appropriate height position can thereby be easily achieved by an operator.

The at least one support element can be coupled with the height adjustment device of the receiving device mechanically or in a signal-biased manner. With mechanical coupling, a direct mechanical connection to the height adjustment device is provided. For example, a mechanical coupling with a drive of the height adjustment device or with a height-adjustable element of the height adjustment device is provided. With signal-biased coupling, a direct mechanical coupling is not necessary. Control signals for the height adjustment device or signals derived therefrom are used to control the at least one support element such that the effective support face is located at the appropriate height position.

In an exemplary embodiment, the at least one support element has a height-adjustable support face. The support element is then positioned such that the height-adjustable support face is at the same height as a rest face of the receiving device.

It is possible for a height adjustment direction of the at least one support face to be at least approximately parallel to a height displacement direction of the receiving device. For example, the support element is formed as a finger which is displaceable in height. By a corresponding positioning of the finger, it is possible to obtain an effective support face.

It is also possible for the at least one support element to be arranged for movement on a knife guard ring. The knife guard ring constitutes a guide device for the support element, and the support element can be displaced into the height position appropriate for its effective support face by a corresponding displacement on the knife guard ring.

For example, it is then provided for the at least one support element to be (mechanically) coupled to the height adjustment device via a joint device. This allows the proper position of the support face to be adjusted automatically as a function of the height position of the receiving device.

In an alternative exemplary embodiment, a plurality of support elements are provided, with different support elements having support faces at different height positions relative to the cutting knife and an effective support element with an effective support face being determined by the height position of the receiving device relative to the cutting knife. When a plurality of in particular finger-like support elements (fingers) are provided, then an effective support face can be implemented by selecting the appropriate support element. The other support elements are then in a non-effective position. It is thereby possible for a support element to move within a minimized spatial area in order to provide an effective support face. This enables the support device for product to be cut to be easily accommodated in a food product cutting machine.

In particular, the support elements are movable between at least one non-effective position and at least one effective position, and an effective support face is provided in the at least one effective position. The respective support element is then selected as a function of the height position of the receiving device and is put into the effective position. The other support elements then do not interfere with the cutting process.

The support elements can be movable in a direction transverse or parallel to a height adjustment direction of the receiving device, depending upon the embodiment.

In particular, the support elements are arranged in parallel. By selecting the corresponding support element (the support elements being positioned at different height positions), it is possible to provide the appropriate effective support face.

In an embodiment, the support elements are spring-biased. Depending upon the arrangement and configuration of a corresponding spring, this enables support elements to be automatically transferred from a non-effective position to an effective position and, vice versa, from an effective position to a non-effective position. In an advantageous embodiment, the spring-biasing is such that when there is no continuous force being exerted on a support element, it will return from an effective position to a non-effective position. This enables a support element to be "retracted" in a simple manner, so that it does not hinder a cutting process or an adjustment process.

In particular, the support elements are fixed in the at least one non-effective position by a fixing device, and the release of the fixing of a support element is effected as a function of the height position of the receiving device. An active height adjustment of the receiving device allows the appropriate support element to be put into an effective position. This requires an active process. In particular, the transition from a non-effective position to an effective position can thereby be implemented by simple constructional means. In particular, the support elements are fixed in their non-effective position by means of a stop plate for product to be cut. When the stop plate is adjusted to different slice thicknesses, the support elements in their non-effective position are also adjusted, and in particular displaced, with the stop plate. When the stop plate is adjusted to a slice thickness below zero, all support elements are located in this position "below zero". The cutting knife is then completely guarded (covered) to protect against accidents.

It is then favourable when the height adjustment device defines discrete height positions for the receiving device which are predetermined by the height position of the support elements. For example, two or more discrete height positions are provided for the receiving device. This allows an adaptation of the height position of the effective support face to the height position of a biasing face of the receiving device to be achieved in a simple manner.

The following description of preferred embodiments serves to explain the invention in greater detail in conjunction with the drawings.

BRIEF DESCRIPTION OF THE DRAWINGS

FIG. 10(*b*) is a sectional view along line 10*b*-10*b* of FIG. 10(*a*); and FIG. 10(*c*) is a view in the direction E of FIG. 10(*a*).

DETAILED DESCRIPTION OF THE INVENTION

Figure 1:
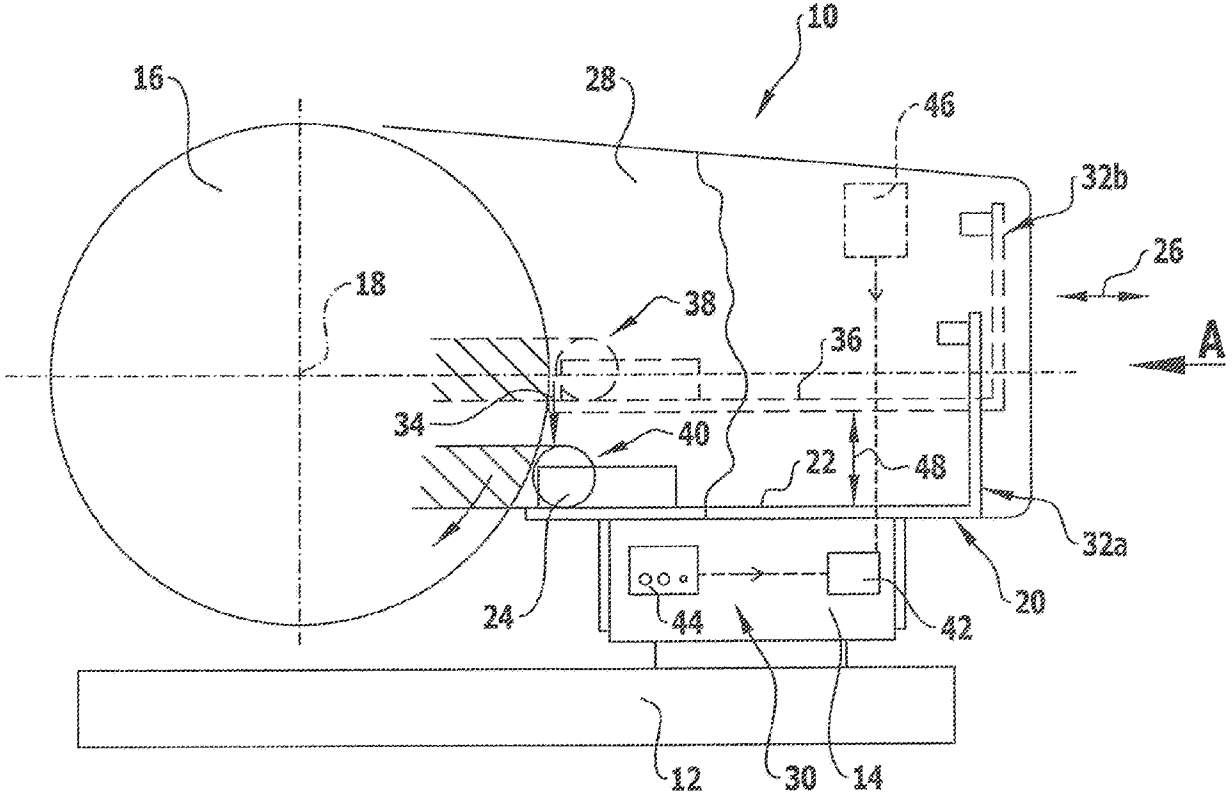
FIG. 1 is a schematic representation of an exemplary embodiment of a food product cutting machine in accordance with the invention, showing two different height positions of a receiving device.

An exemplary embodiment of a food product cutting machine which is shown in FIG. 1 and indicated therein by 10 comprises a base 12 by means of which the food product cutting machine 10 can be placed on a support. Arranged at the base 12 is a housing 14, or the base 12 is part of the housing 14.

The food product cutting machine 10 comprises a cutting knife 16 which is driven for rotational movement about an axis of rotation 18. The drive, not shown in FIG. 1, is arranged inside the housing 14.

In the exemplary embodiment illustrated, the axis of rotation 18 is perpendicular to the drawing plane.

The cutting knife 16 is in particular a circular knife.

Arranged at the housing 14 is a carriage 20. A receiving device 22 for a product to be cut 24 is positioned at the carriage 20.

The carriage 20 is displaceable in a direction/counter-direction 26 relative to the cutting knife 16. The displacement motion of the carriage 20 may be driven by hand (by an operator) or by a motor, or provision may be made for motorized assistance during manual operation.

The direction/counter-direction 26 is in particular perpendicular to the axis of rotation 18 of the cutting knife 16.

Arranged at the housing 14 is a stop plate 28 whose distance (in a direction parallel to the axis of rotation 18, transverse to the direction/counter-direction 26) relative to the cutting knife 16 and hence to a cutting plane is adjustable. By adjusting the position of the stop plate 28 relative to the cutting knife 16, a cutting thickness of the food slices that are cut from the food product 24 can be adjusted.

The food product cutting machine 10 comprises a height adjustment device 30 by means of which height positions of the receiving device 22 relative to the housing 14 and hence also to the cutting knife 16 are adjustable. FIG. 1 indicates two different height positions, 32*a* and 32*b*.

The height adjustment device 30 is, for example, at least in part arranged at the carriage 20 and can be carried along with it.

A height displacement of the receiving device 22 at the carriage 20 is preferably driven. For example, an electric motor, a pneumatic drive, or a hydraulic drive is provided to this end.

It is, in principle, possible for the corresponding drive to be arranged in the housing 14 and not to be moved with the carriage 20. A corresponding transmission device (not shown) is then provided which transmits the drive force or drive torque of the drive to the receiving device 22 in order to adjust (and secure) the height position. For example, it is provided for the carriage 20 to have a distinct position relative to the housing 14 in which the transmission device can be effective to allow a height position of the receiving device 22 to be adjusted.

It is also possible for the height adjustment device 30 as a whole to be displaced with the carriage 20.

The height adjustment device 30 allows the product to be cut 24 having a certain diameter to be put into an optimum cutting position relative to the cutting knife 16. For example, product to be cut 24 having a smaller diameter can be displaced upwards with respect to the vertical direction in order to enable the cutting knife 16 to attack at a point closer to an apex.

In particular, the food product cutting machine 10 is configured such that the cutting knife 16 is translationally fixed. The carriage 20 displaces product to be cut 24 relative to the cutting knife 16. The adjustability in height of the receiving device 22 enables the cutting knife 16 to penetrate product to be cut 24 when a velocity vector 34 of the rotating cutting knife is substantially perpendicular to a rest face 36 of the receiving device 22. A correspondingly positioned product to be cut 24 is indicated in FIG. 1 by the reference numeral 38. Reference numeral 40 indicates product to be cut 24 for which this is not the case. Here, the velocity vector is inclined with respect to the rest face 36. In the latter case, tearing forces occur on the product to be cut 24 which can influence the quality of the cut; they may give the edges of the product to be cut 40 a "raggy" appearance.

The height adjustment device 30 enables an adaptation as a function of the diameter of the product to be cut.

It can be provided for the receiving device 22 to have a plurality of height positions, and continuous transition is possible. It is, in principle, also possible for the receiving device 22 to have discrete height positions 32*a*, 32*b* and to have, for example, two or more discrete height positions.

The food product cutting machine 10 comprises a control device 42 by means of which the height adjustment device 30 is adjustable such that a suitable height position is adjusted and also secured via a fixing device (not shown).

It is, in principle, possible for parameters to be set via an operator control device 44, where the control device 42 then controls the height adjustment device 30 accordingly. For example, a parameter for the height position or a parameter for the diameter of the product to be cut 24 can be set via the operator control device 44.

It is, in principle, also possible for a sensor device 46 to be provided that is usable to detect a diameter of the product to be cut 24. The sensor device 46 is, for example, an optical device which measures the diameter of the product to be cut resting on the rest face 36.

It is also possible for the sensor device 46 to be a mechanical device. This comprises, for example, a bar (not shown) which is to be brought in contact with product to be cut 24 resting on the rest face 36. The diameter of the product to be cut can then be determined from the position of the bar.

It is, in principle, also possible for a diameter of the product to be cut to be determined from the current torque which is measured when the cutting knife 16 penetrates the product to be cut 24.

When the sensor device 46 is provided, the appropriate height position of the receiving device 22 can be adjusted automatically as a function of the result of the detection of the diameter of the product to be cut.

A height adjustment direction 48 of the height adjustment device 30 is transverse and in particular perpendicular to the axis of rotation 18, and transverse and in particular perpendicular to the direction/counter-direction 26 of the displaceability of the carriage.

Figure 2:
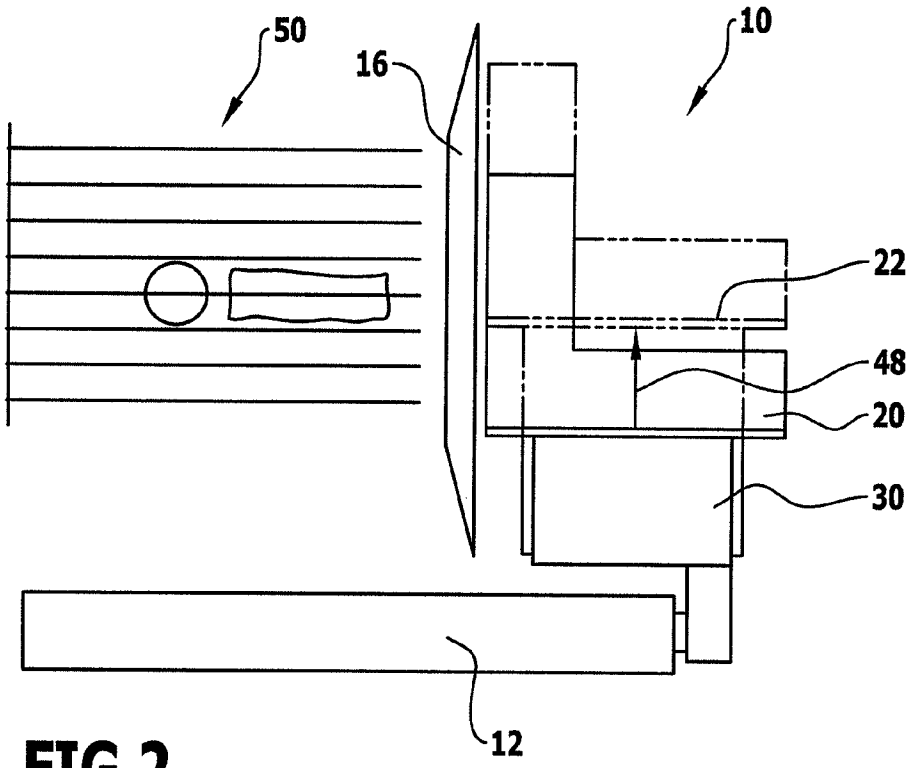
FIG. 2 is a view of the food product cutting machine of FIG. 1, as seen in the direction A.

Slices of the food product can be carried away from the cutting knife 16 via a transport device 50 which may be, for example, a chain frame device (FIG. 2).

Arranged around the cutting knife 16 is a knife guard ring 52 (FIG. 3) that covers the cutting knife 16 except for a cutting area 54.

The food product cutting machine 10 comprises a support device 56 for product to be cut 24 by means of which the product to be cut can be supported as it is cut. The support device 56 for product to be cut 24 comprises a support face 58 which defines a counter-bearing during a cutting process. The support face 58 is arranged between the cutting knife 16, or the stop plate 28, and the carriage 20. It is arranged such that the movability of the carriage 20 in the direction/counter-direction 26 is enabled. The adjustability of the stop plate 28 relative to the cutting knife 16 is also enabled.

Figure 3:
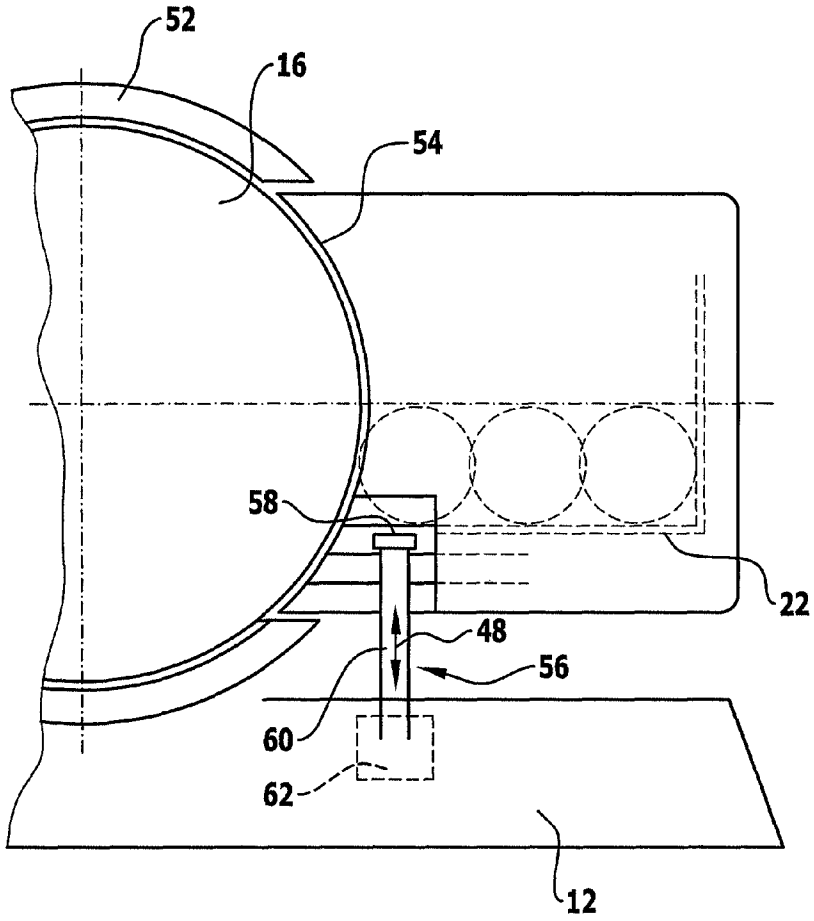
FIG. 3 is a schematic representation of a first exemplary embodiment of a support device for product to be cut.
Figure 4:
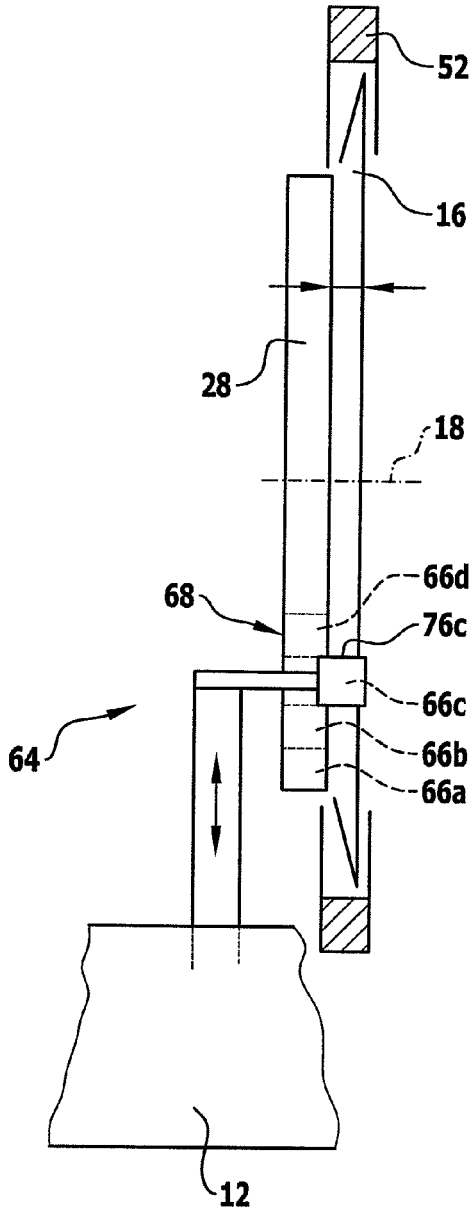
FIG. 4 is a schematic partial representation of a second exemplary embodiment of a support device for product to be cut in accordance with the invention.
Figure 5:
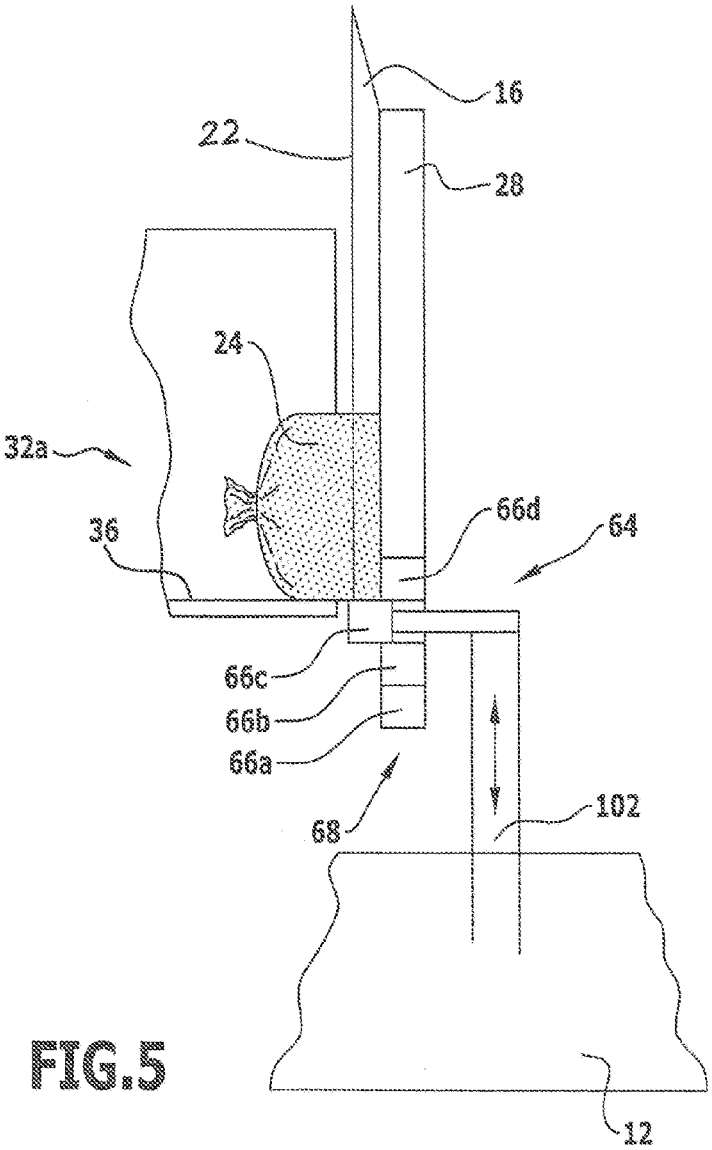
FIG. 5 is a further view of the support device for product to be cut shown in FIG. 4.
Figure 6:
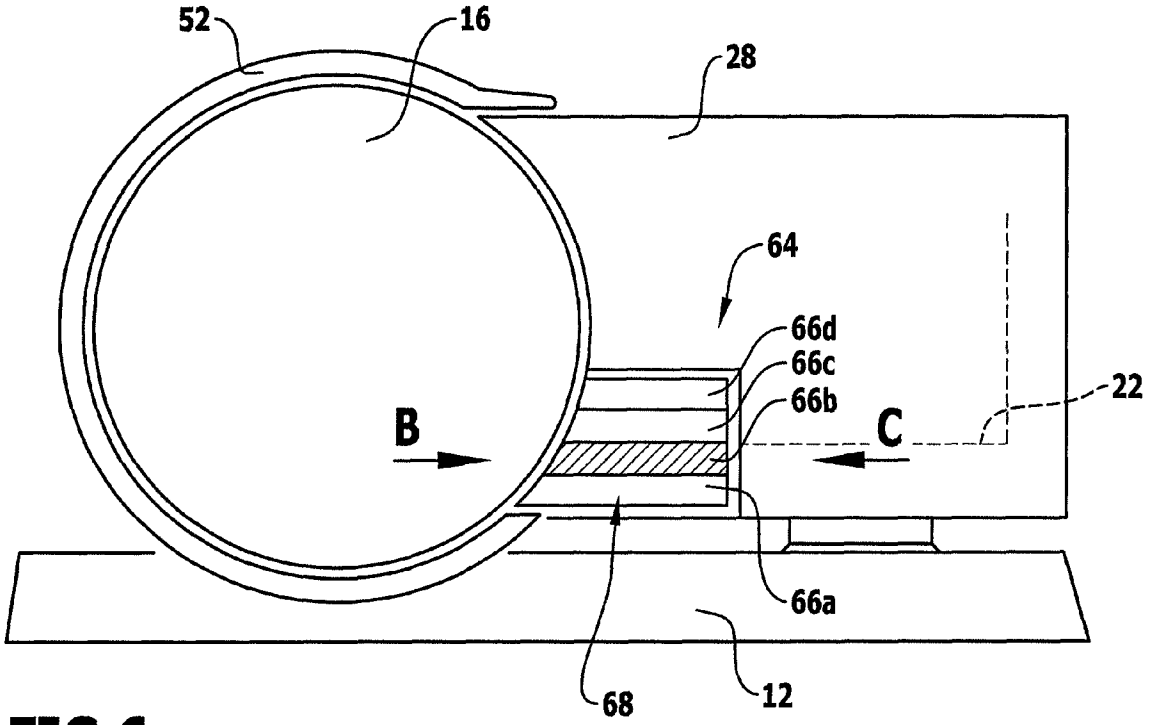
FIG. 6 is a further representation of the support device for product to be cut shown in FIG. 4, with FIG. 4 being a view in the direction C and FIG. 5 being a view in the direction B.

In a first exemplary embodiment, shown schematically in FIG. 3, the support device 56 for product to be cut 24 comprises a support element 60 having the support face 58 formed thereat. The support element 60 is displaceable in height in a direction parallel to the height adjustment direction 48.

It is, in principle, possible for the support element 60 to be supported for displacement transverse to the direction 48 at the base 12 or housing 14 in order to enable the displaceability of the stop plate 28. The support element 60 is coupled to the height adjustment device 30. This coupling can be a mechanical coupling or a signal-biased coupling. In the latter case, the control device 42 provides signals to a drive 62 (for example, an electric motor), the signals causing the height of the support element 60 to be adjusted in a manner adapted to the height position of the receiving device 22. The receiving device 22 is adjustable in height; for this reason, the effective support face 58 has to be adapted to the height position of the receiving device 22. This is enabled by the height-displaceable support element 60. The height adjustment of the support face 58 is effected as a function of the height position of the receiving device 22 by the mechanical coupling or the signal-biased coupling, so that the proper height position of the support face 58 is achieved automatically.

In the support element 60, the support face 58 is adapted to the height position of the receiving device 22 by height adjustment of the support face 58 in the direction 48.

In a second embodiment of a support device for product to be cut, which is shown in FIGS. 4 through 7 and indicated therein by 64, a plurality of support elements 66*a* to 66*d* are provided. The support elements 66*a* to 66*d* are arranged at a holding device 68. The holding device 68 is fixed at the stop plate 28 and displaceable therewith or is fixed at the base 12 and can be stationary or displaceable in a direction parallel to the direction of displacement of the stop plate 28.

The support elements 66*a* to 66*d* are aligned in parallel with a longitudinal axis 70 which is transverse and in particular perpendicular to a cutting plane 72. The longitudinal axis 70 is in particular parallel to a direction of displacement of the stop plate 28.

The holding device 68 has a plurality of receptacles 74, with the number of receptacles 74 corresponding to the number of support elements 66*a* to 66*d* and the support elements 66*a* to 66*d* each being arranged in a receptacle 74 of their own.

The support elements 66*a* to 66*d* are supported for displacement in their receptacles 74, with the direction of displacement being parallel to the longitudinal axis 70.

The support elements 66*a* to 66*d* have support faces 76*a* to 76*d* respectively, which are arranged on a side of the respective support elements 66*a* to 66*d* that is facing away from the base 12. The support faces 76*a* to 76*d* are, for example, flat faces. In principle, however, it is also possible for each of these support faces 76*a* to 76*d* to be curved faces.

The support elements 66*a* to 66*d* each have a support face portion 78 and a holding portion 80. The holding portion 80 is in particular configured as a pin 82. A spring 84 is arranged around the pin 82. A first end 86*a* of the spring 84 rests on a receptacle wall 88. A second end 86*b* of the spring rests on an annular element 90 fixedly mounted at a center portion thereof on the pin 82. The spring 84 tends to displace the respective support element in the holding device 68 and to hold it such that the associated support face does not protrude beyond a front plane 92 of the holding device 68. It is thereby part of a fixing device 93 for the respective support element. At the same time, the front plane 92 constitutes, at least in part, a contact face for product to be cut contacting the stop plate 28.

The support elements 66*a* to 66*d* have a non-effective position 94 in which they are held (fixed) by the respective springs 84 and in which the associated support elements 66*a* to 66*d* do not protrude beyond the front plane 92. In this position, a section 96 of the holding portion 80 protrudes beyond a back side 98 of the holding device 68 opposing the front plane 92. To this end, the holding device 68 has respective apertures 100 arranged in the area of its back side 98 through which the pins 82 can pass.

Coupled to the height adjustment device 30 is a biasing element 102 which can act upon a pin 82, more precisely on only one pin 82 at a time. The biasing element 102 is height-adjustable with the receiving device 22. The height position of the receiving device 22 defines a height position of a biasing portion 104 of the biasing element 102.

Figure 7:
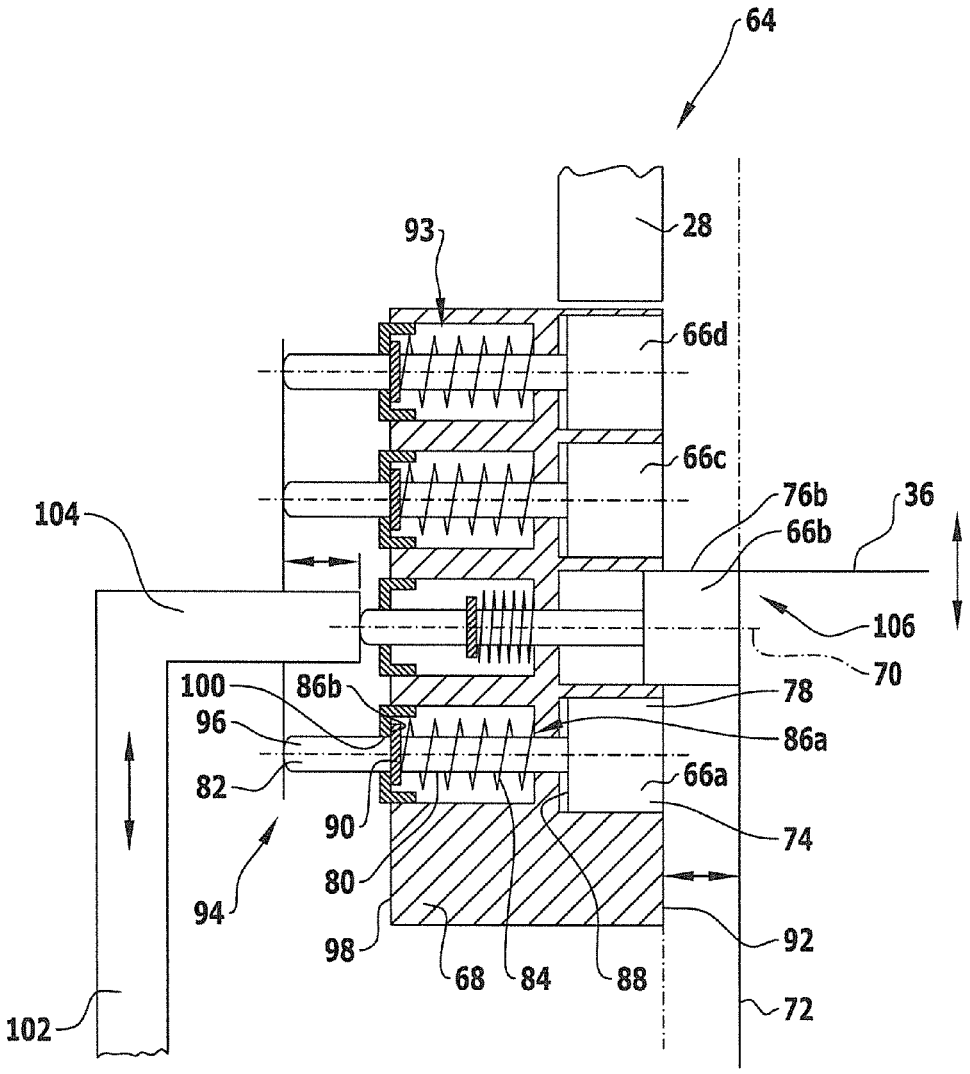
FIG. 7 is an enlarged schematic representation of the support device for product to be cut illustrated in FIG. 4.

Depending on its height position, the biasing portion 104 acts upon the pin 82 of a particular support element 66*a* to 66*d* and puts it in an effective position 106. In FIG. 7, this effective position 106 is shown for the support element 66*b*.

The biasing portion 104 pushes on the pin 82 against the action of the corresponding spring 84, thereby pushing the support face 76*b* to extend beyond the front plane 92. The support face 76*b* thus becomes an effective support face upon which product to be cut can rest as it is cut. The support face 76*b* is at least approximately at the same height as (exactly at the same height as or only slightly lower than) the rest face 36 of the receiving device 22.

It is preferably provided for the pins 82 to have their surfaces provided with a corresponding guide edge which is effective to allow the biasing portion 104 to engage a pin 82 and displace it, by displacement in height, against the action of the spring 84 into the effective position 106. As soon as the biasing portion 104 no longer acts upon the corresponding pin 82, the associated support element, due to the spring action of the spring 84, returns to the non-effective position 94.

In order to allow the height displacement to be carried out, the stop plate 28 must previously have been set to a position below zero. In this position, the stop plate 28 is located in front of the cutting knife 16. The stop plate 28 is then adjusted after the height displacement of the biasing portion 104. A particular slice thickness for the food products to be cut is thereby adjusted. This also automatically actuates pin 82.

In particular, it can be provided for the stop plate 28 to be adjusted automatically by motor power when the stop plate 28 is still set to the "below-zero" position for automatic height adjustment. In that case, a manual rotary knob for slice thickness adjustment is not necessary.

In this exemplary embodiment, the receiving device 22 has discrete height positions, the number of height positions being predetermined by the number of support elements 66*a* to 66*d*. In the embodiment shown, four support elements 66*a* to 66*d* are provided, so that there are four discrete height positions for the receiving device 22. These height positions are adapted to the height positions of the support elements 66*a* to 66*d* at the holding device 68, so that in the respective height position, the relevant support face 76*a* to 76*d* is at the same height as the rest face 36 of the receiving device 22.

The coupling of the biasing element 102 to the height adjustment device 30 can be a mechanical coupling or a signal-biased coupling. For example, the control device 42 outputs signals to the height adjustment device 30 and the biasing element 102 in order to achieve a synchronous height adjustment.

The relevant support element 66*a* to 66*d* is selected automatically as a function of the respective height position of the receiving device 22.

Figure 8:
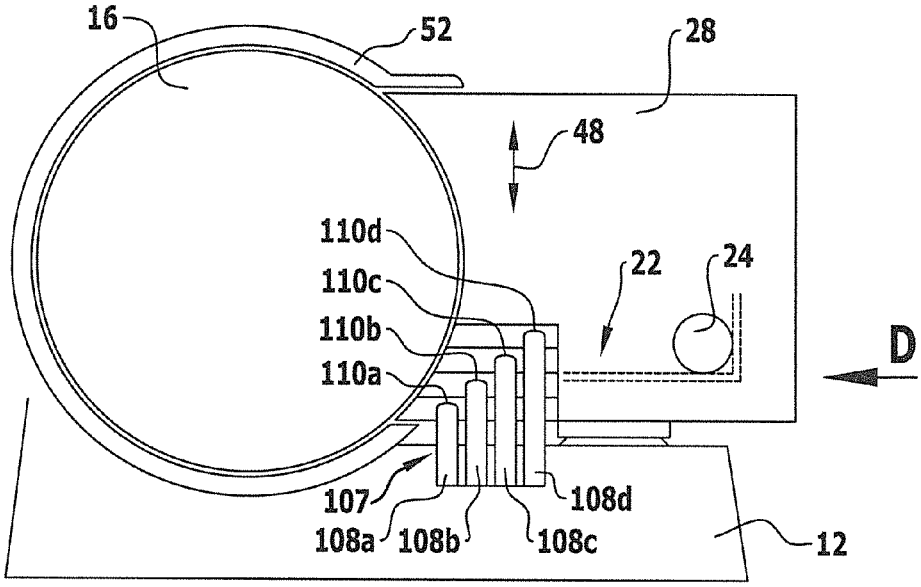
FIG. 8 shows a further exemplary embodiment of a food product cutting machine in accordance with the invention with a third exemplary embodiment of a support device for product to be cut in accordance with the invention.
Figure 9:
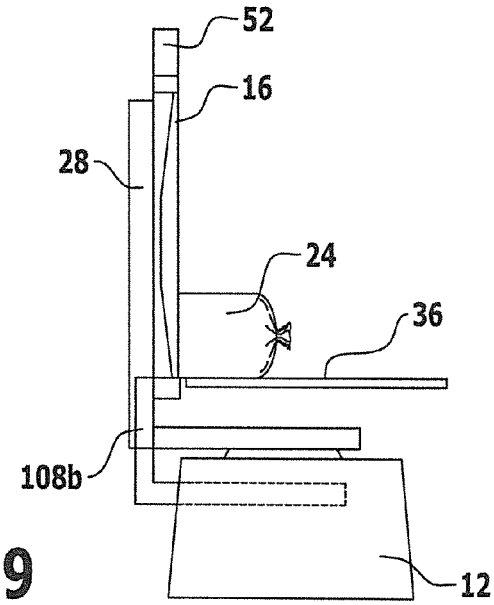
FIG. 9 is a view of the food product cutting machine of FIG. 8, as seen in the direction D.

In a third exemplary embodiment of a support device 107 for product to be cut which is shown schematically in FIGS. 8 and 9, the support device 107 for product to be cut comprises a plurality of support elements 108*a*, 108*b*, 108*c*, 108*d* which are arranged transverse and in particular perpendicular to the direction/counter-direction 26 and to the axis of rotation 18. For example, the support elements 108*a*, etc. are oriented in the vertical direction.

The support elements have respective support faces 110*a* to 110*d*. In particular, the support elements 108*a* to 108*d* are arranged in parallel to each other and are movable parallel to the height adjustment direction 48. In principle, the displaceability and fixing can be implemented in the same way as for the support elements 66*a* to 66*d*.

Depending on the height position of the receiving device 22, the relevant support element 108*a*, 108*b*, 108*c* or 108*d* is extended in order to keep the corresponding support face and the rest face 36 at the same height.

Figure 10A:
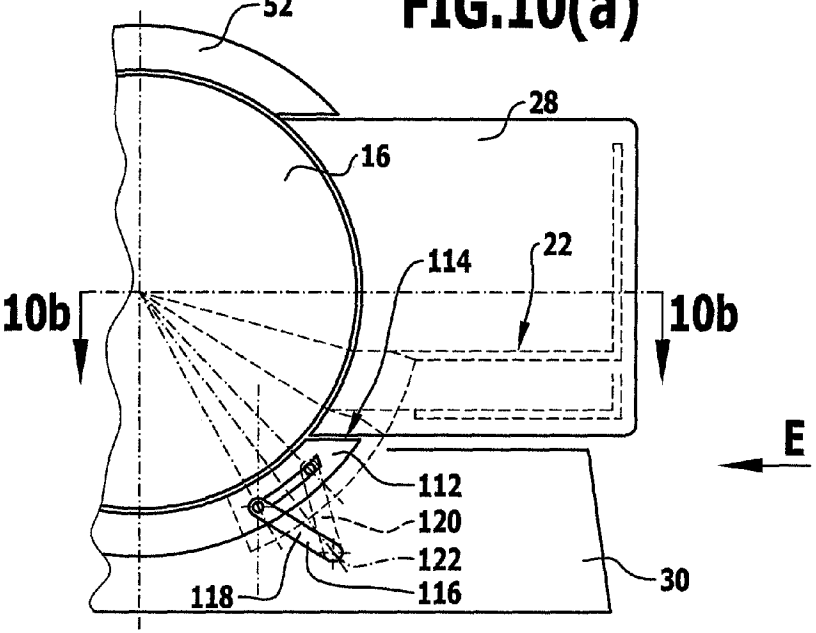
FIG. 10(*a*) is a schematic representation of a fourth exemplary embodiment of a support device for product to be cut in accordance with the invention.
Figure 10B:
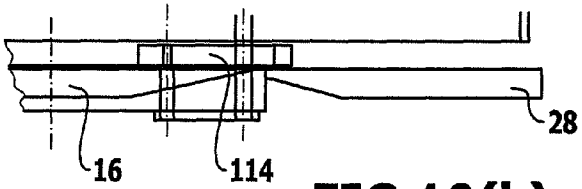
Figure 10C:
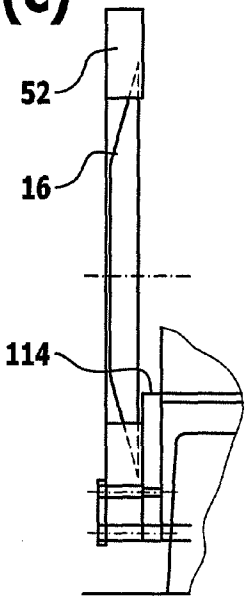

In a fourth exemplary embodiment of a support device for product to be cut, which is shown in FIGS. 10(*a*) to 10(*c*), a support element 112 is arranged for displacement at the knife guard ring 52. This support element 112 has a support face 114. The knife guard ring 52 provides a guide for displacement of the support element 112. This support element is mechanically coupled to the height adjustment device 30 via a joint device 116. The displacement position of the support element 112 at the knife guard ring and thus also the height of the support face 114 are adjusted as a function of the height position of the receiving device 22 in order, in particular, to cause the support face 114 to be located substantially at the same height as the rest face 36 during cutting and to thereby obtain an effective support during cutting.

The joint device 116 comprises, for example, a lever 118 which is joined to the support element 112. The lever 118 can be pivoted on a fulcrum 122 into a position 120 via the height adjustment device 30. The position 120 is shown in FIG. 10(*a*) in broken lines. Continuous, adaptable heights of the support element 112 are adjustable via a continuous pivot angle, the pivot angle being determined by the coupling to the height adjustment device 30.

In the solution in accordance with the invention, the support device for product to be cut 24 is coupled to the height adjustment device 30. Upon adjustment of a defined height position of the receiving device 22 for the product to be cut 24, the proper height for the effective support face is adjusted automatically so as to obtain, independently of the height position of the receiving device 22, a reliable support of the food product as it is cut.

Thus, by adjusting the height position in a manner adapted to the diameter of the product to be cut, a cutting process can be implemented with minimal tearing forces. The product to be cut is supported in an optimized manner.

The invention claimed is:

1. A food product cutting machine comprising:

a driveable cutting knife defining a cutting plane;

a receiving device for a product to be cut, the receiving device comprising an orthogonal rest face that extends substantially perpendicular to the cutting plane for supporting the product to be cut, wherein an end of the orthogonal rest face closest to the cutting plane defines an end plane that is parallel to the cutting plane;

a height adjustment device operatively connected to the receiving device, wherein the height adjustment device adjusts a height position of the orthogonal rest face relative to the cutting knife for adjusting a height position of the product to be cut relative to the cutting knife, the orthogonal rest face remaining orthogonal to the cutting plane during the adjusting of the height position of the orthogonal rest face;

a carriage displaceable relative to the cutting knife and having the receiving device arranged thereat; and in addition to the carriage, a support device arranged to support the product to be cut, the support device having a plurality of support elements that are movable relative to one another, each support element having a corresponding support face, each support element being moveable between a non-effective position and an effective position, and each support element, when located in the effective position, being located between the cutting plane and the end plane so as to be capable of supporting the product to be cut on the corresponding support face as the product is cut, the corresponding support face defining a counter-bearing during a cutting operation, and each support element, when located in the non-effective position, being not capable of supporting the product to be cut on the corresponding support face as the product is cut;

wherein the support device is coupled with the height adjustment device, and in dependence of the height position of the orthogonal rest face of the receiving device, a corresponding one of the plurality of support elements is located in the effective position, wherein the corresponding support face of said corresponding one of the plurality of support elements is at the same height or at a slightly lower height than the orthogonal rest face.

2. The food product cutting machine in accordance with claim 1, wherein a control device is operatively connected to said height adjustment device for controlling the height position of the receiving device.

3. The food product cutting machine in accordance with claim 2, wherein a sensor device for determining a diameter of the product to be cut is provided, the sensor device being operatively connected to the control device for providing signals to the control device so that the control device controls the height adjustment device for adjusting the height position of the orthogonal rest face based on the diameter of the product to be cut.

4. The food product cutting machine in accordance with claim 2, wherein an operator control device is provided which is coupled to the control device and which is usable by an operator to set at least one of a parameter for the height position and a parameter for the diameter of the product to be cut.

5. The food product cutting machine in accordance with claim 1, wherein each support element is coupled with the height adjustment device mechanically or in a signal-biased manner.

6. The food product cutting machine in accordance with claim 1, wherein the plurality of support elements are arranged in parallel.

7. The food product cutting machine in accordance with claim 1, wherein the plurality of support elements are spring-biased.

8. The food product cutting machine in accordance with claim 1, wherein the plurality of support elements are fixed in the at least one non-effective position by a fixing device, and wherein a release of a fixing of said one support element is effected as a function of the height position of the receiving device.

9. The food product cutting machine in accordance with claim 1, wherein the height adjustment device defines discrete height positions for the receiving device which are predetermined by the height positions of the plurality of support elements.

10. The food product cutting machine in accordance with claim 1, wherein the plurality of support elements are movable in a direction transverse to a height adjustment direction of the receiving device.

* * * * *